US006478113B1

(12) United States Patent
Ellison

(10) Patent No.: US 6,478,113 B1
(45) Date of Patent: Nov. 12, 2002

(54) LADDER LEVELING SYSTEM

(76) Inventor: Julian P. Ellison, 10 Lawford Close, Chorleywood, Hertfordshire (GB), WD3 5JX ( * ) Notice: Subject to any disclaimer, the term of this patent is extended or adjusted under 35 U.S.C. 154(b) by 16 days.

(21) Appl. No.: 09/612,082

(22) Filed: Jul. 7, 2000

(51) Int. Cl.[7] ..... E06C 1/00; E06C 7/00

(52) U.S. Cl. ..... 182/204; 182/200; 182/205

(58) Field of Search ..... 182/204, 205, 182/200–203; 248/188.2, 188.3, 188.4, 188.5

(56) References Cited

U.S. PATENT DOCUMENTS

| | | | | | |
|---|---|---|---|---|---|
| 1,376,777 | A | * | 5/1921 | O'Connor | 182/205 |
| 2,127,884 | A | * | 8/1938 | Overpeck | 182/205 |
| 2,147,052 | A | * | 2/1939 | Noone | 182/205 |
| 2,275,086 | A | * | 3/1942 | Moore | 182/205 |
| 2,405,269 | A | * | 8/1946 | Prutsman | 182/205 |
| 2,458,076 | A | * | 1/1949 | Houston | 182/205 |
| 2,468,856 | A | * | 5/1949 | Alexander | 248/188.2 X |
| 4,249,638 | A | | 2/1981 | Fernandez | |
| 4,770,275 | A | | 9/1988 | Williams | |
| 5,064,024 | A | | 11/1991 | Barham | |
| 5,148,892 | A | | 9/1992 | Lu | |
| 5,154,257 | A | | 10/1992 | Mirles | |
| 5,307,900 | A | * | 5/1994 | Noga | 182/204 |
| 5,476,153 | A | * | 12/1995 | Dickerson et al. | 182/204 |
| D371,608 | S | | 7/1996 | Mintz et al. | |
| D373,428 | S | | 9/1996 | Nashleanas | |
| 5,816,364 | A | | 10/1998 | Christy et al. | |
| 6,234,273 | B1 | * | 5/2001 | Moore | 182/204 |

* cited by examiner

*Primary Examiner*—Alvin Chin-Shue
*Assistant Examiner*—Hugh B. Thompson

(57) ABSTRACT

A ladder leveling system for facilitating the safe use of a ladder on uneven surfaces and maintaining the rungs of the ladder in a substantially horizontal orientation. The ladder leveling system includes a ladder with a pair of side rails and a plurality of rungs extending between the side rails, a pair of legs with leg teeth, a plurality of clamping members for selectively urging the engagement of the leg teeth, a pair of foot members coupled to the legs, and a level coupled to a rung of the ladder for facilitating positioning of the ladder such that the rungs are substantially horizontal.

1 Claim, 3 Drawing Sheets

LADDER LEVELING SYSTEM

BACKGROUND OF THE INVENTION

1. Field of the Invention

The present invention relates to ladder leveling devices and more particularly pertains to a new ladder leveling system for facilitating the safe use of a ladder on uneven surfaces and maintaining the rungs of the ladder in a substantially horizontal orientation.

2. Description of the Prior Art

The use of ladder leveling devices is known in the prior art. More specifically, ladder leveling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,064,024; U.S. Pat. No. 5,816,364; U.S. Pat. No. 5,154,257; U.S. Pat. No. 4,249,638; U.S. Pat. No. 5,148,892; U.S. Pat. No. 4,770,275, U.S. Pat. No. Des. 371,608; and U.S. Pat. No. Des. 373,428.

While these devices fulfill their respective, particular objectives and requirements, the aforementioned patents do not disclose a new ladder leveling system. The inventive device includes a ladder with a pair of side rails and a plurality of rungs extending between the side rails, a pair of legs with leg teeth, a plurality of clamping members for selectively urging the engagement of the leg teeth, a pair of foot members coupled to the legs, and a level coupled to a rung of the ladder for facilitating positioning of the ladder such that the rungs are substantially horizontal.

In these respects, the ladder leveling system according to the present invention substantially departs from the conventional concepts and designs of the prior art, and in so doing provides an apparatus primarily developed for the purpose of facilitating the safe use of a ladder on uneven surfaces and maintaining the rungs of the ladder in a substantially horizontal orientation.

SUMMARY OF THE INVENTION

In view of the foregoing disadvantages inherent in the known types of ladder leveling devices now present in the prior art, the present invention provides a new ladder leveling system construction wherein the same can be utilized for facilitating the safe use of a ladder on uneven surfaces and maintaining the rungs of the ladder in a-substantially horizontal orientation.

The general purpose of the present invention, which will be described subsequently in greater detail, is to provide a new ladder leveling system apparatus and method which has many of the advantages of the ladder leveling devices mentioned heretofore and many novel features that result in a new ladder leveling system which is not anticipated, rendered obvious., suggested, or even implied by any of the prior art ladder leveling devices, either alone or in any combination thereof.

To attain this, the present invention generally comprises a ladder with a pair of side rails and a plurality of rungs extending between the side rails, a pair of legs with leg teeth, a plurality of clamping members for selectively urging the engagement of the leg teeth, a pair of foot members coupled to the legs, and a level coupled to a rung of the ladder for facilitating positioning of the ladder such that the rungs are substantially horizontal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new ladder leveling system apparatus and method which has many of the advantages of the ladder leveling devices mentioned heretofore and many novel features that result in a new ladder leveling system which is not anticipated, rendered obvious, suggested, or even implied by any of the prior art ladder leveling devices, either alone or in any combination thereof.

It is another object of the present invention to provide a new ladder leveling system which may be easily and efficiently manufactured and marketed.

It is a further object of the present invention to provide a new ladder leveling system which is of a durable and reliable construction.

An even further object of the present invention is to provide a new ladder leveling system which is susceptible of a low cost of manufacture with regard to both materials and labor, and which accordingly is then susceptible of low prices of sale to the consuming public, thereby making such ladder leveling system economically available to the buying public.

Still yet another object of the present invention is to provide a new ladder leveling system which provides in the apparatuses and methods of the prior art some of the advantages thereof, while simultaneously overcoming some of the disadvantages normally associated therewith.

Still another object of the present invention is to provide a new ladder leveling system for facilitating the safe use of a ladder on uneven surfaces and maintaining the rungs of the ladder in a substantially horizontal orientation.

Yet another object of the present invention is to provide a new ladder leveling system which includes a ladder with a pair of side rails and a plurality of rungs extending between the side rails, a pair of legs with leg teeth, a plurality of clamping members for selectively urging the engagement of the leg teeth, a pair of foot members coupled to the legs, and a level coupled to a rung of the ladder for facilitating positioning of the ladder such that the rungs are substantially horizontal.

Still yet another object of the present invention is to provide a new ladder leveling system that allows the positioning of the ladder to be verified for both plumb and level with respect to surrounding environment.

These together with other objects of the invention, along with the various features of novelty which characterize the invention, are pointed out with particularity in the claims annexed to and forming a part of this disclosure. For a better understanding of the invention, its operating advantages and the specific objects attained by its uses,.reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
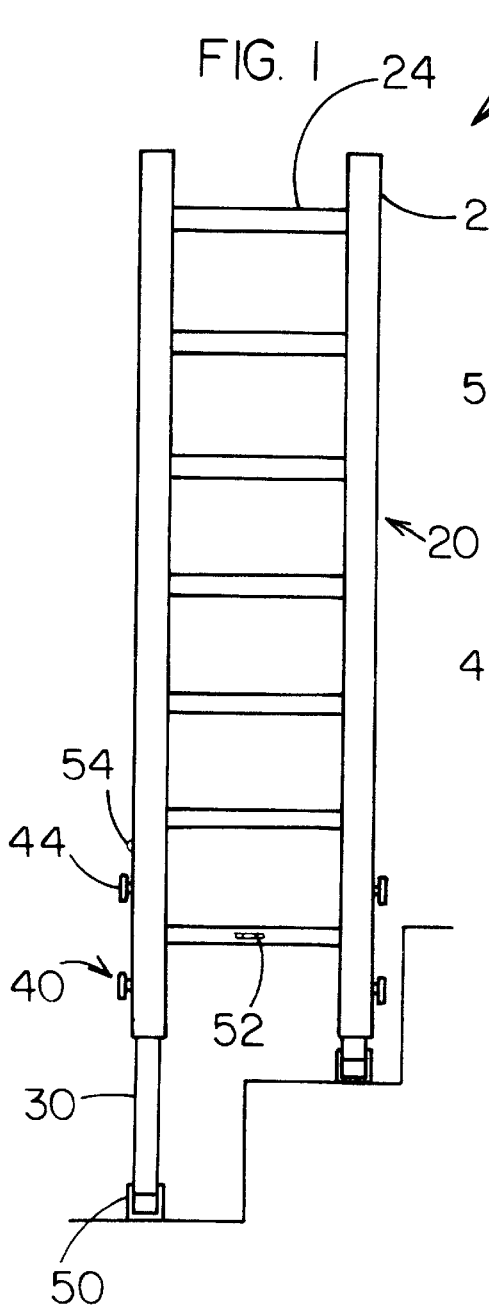
FIG. 1 is a schematic front view of a new ladder leveling system according to the present invention.
Figure 2:
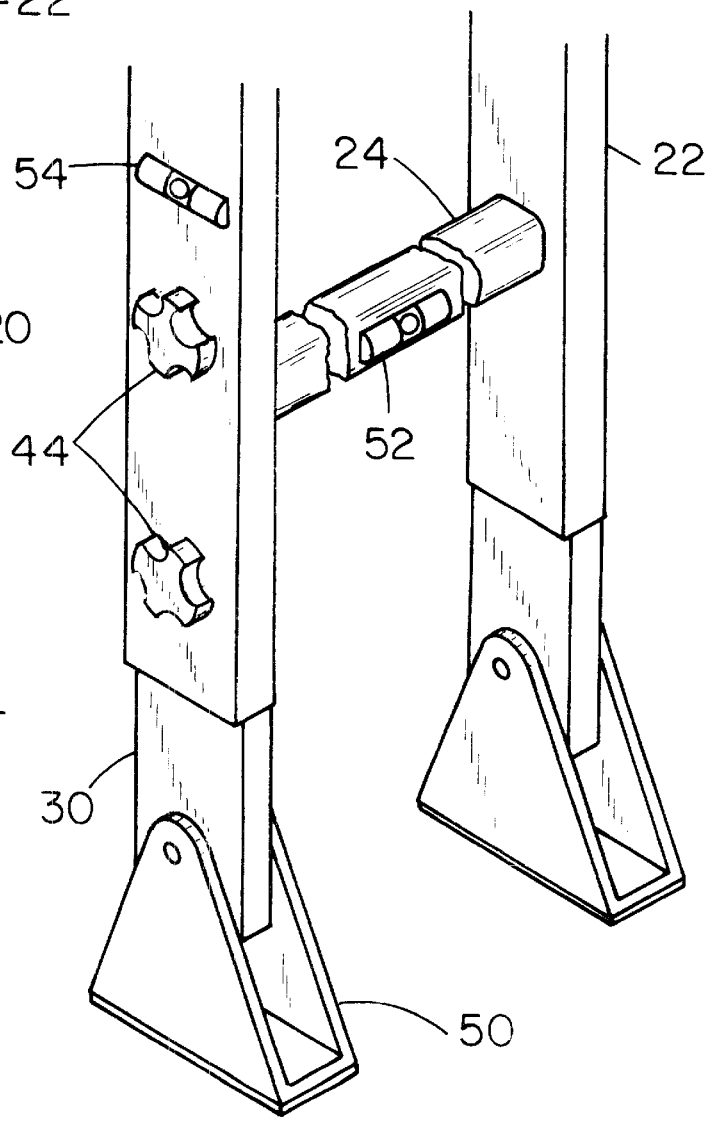
FIG. 2 is a schematic perspective view of the present invention.
Figure 3:
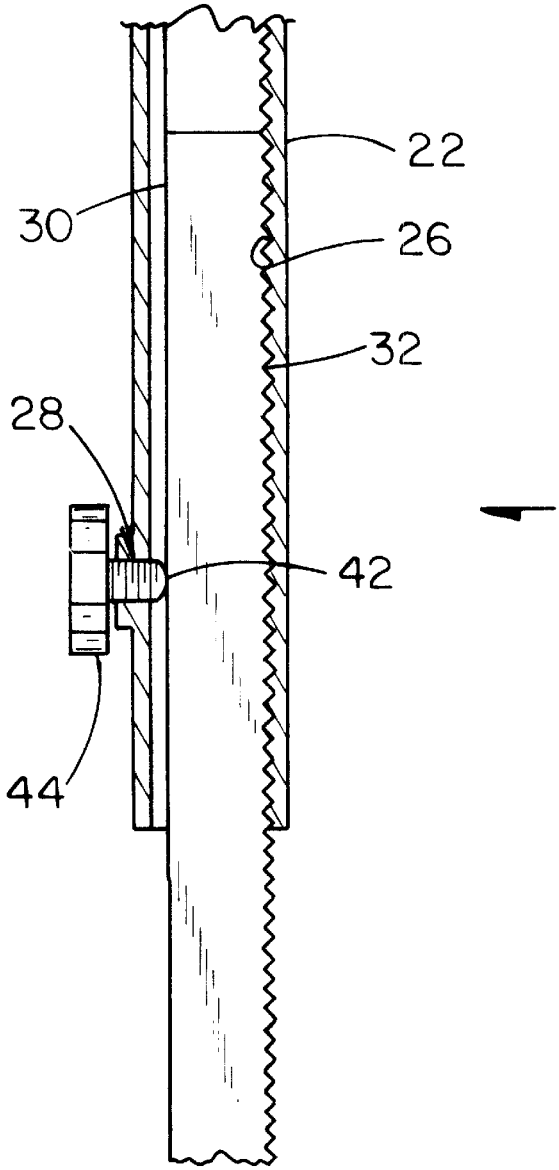
FIG. 3 is a schematic interior view of the leg and side rail portions of the present invention.
Figure 4:
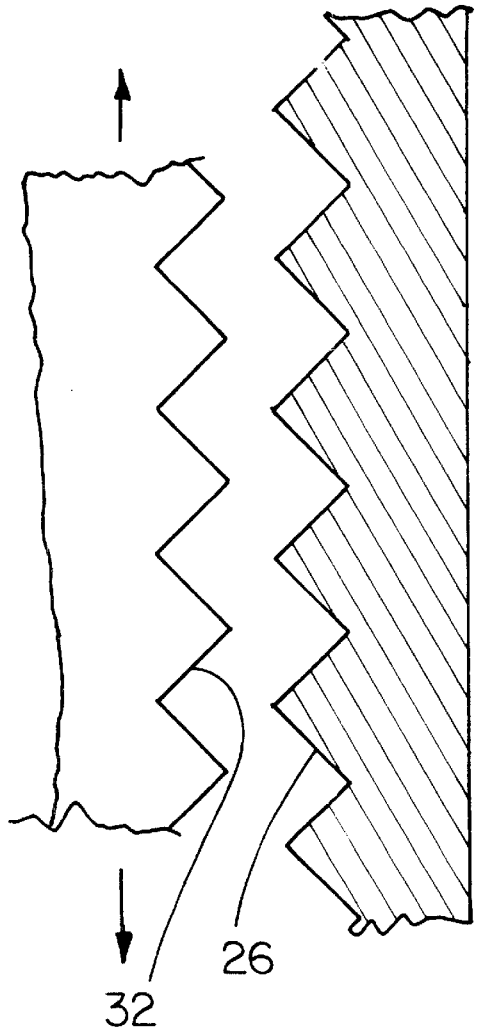
FIG. 4 is a schematic detail view of the leg teeth and rail teeth of the present invention.
Figure 5:
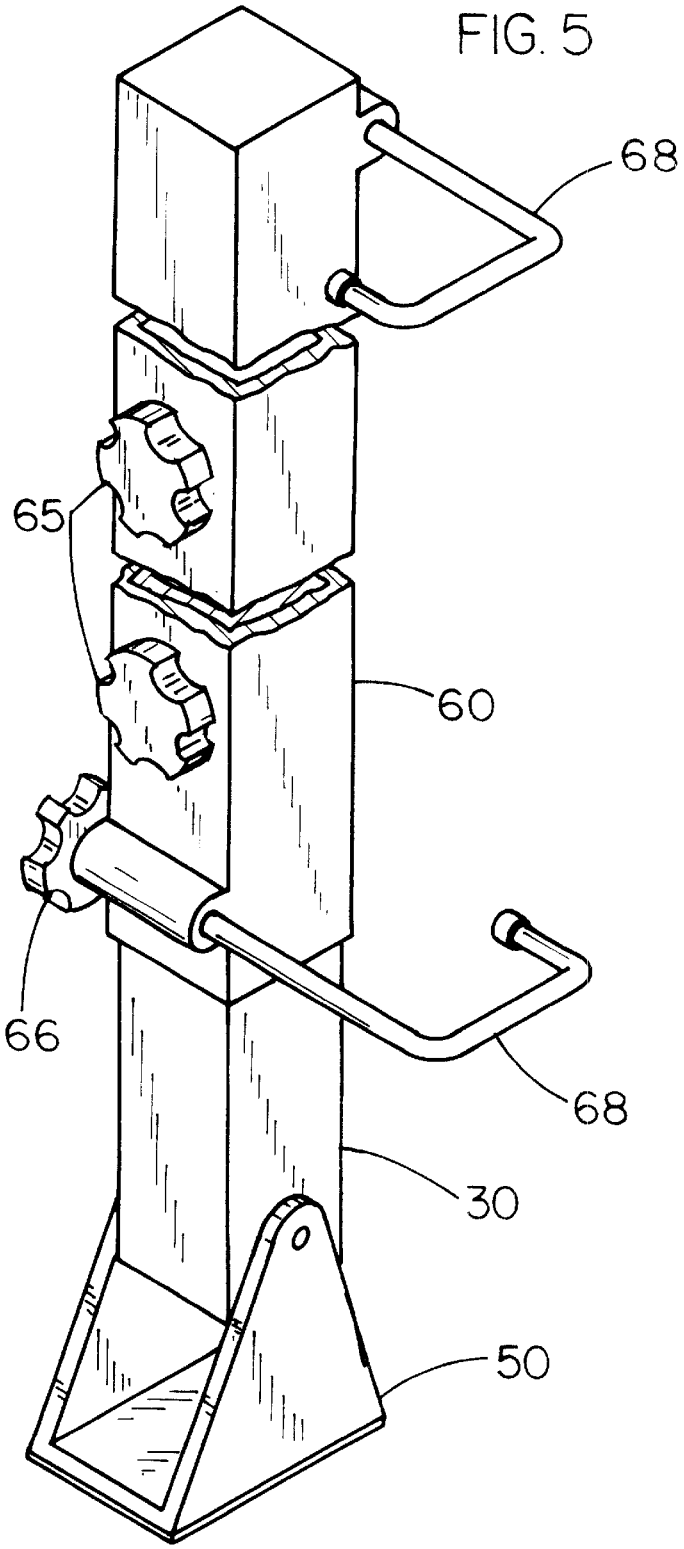
FIG. 5 is a schematic perspective view of an alternate embodiment of the present invention.
Figure 6:
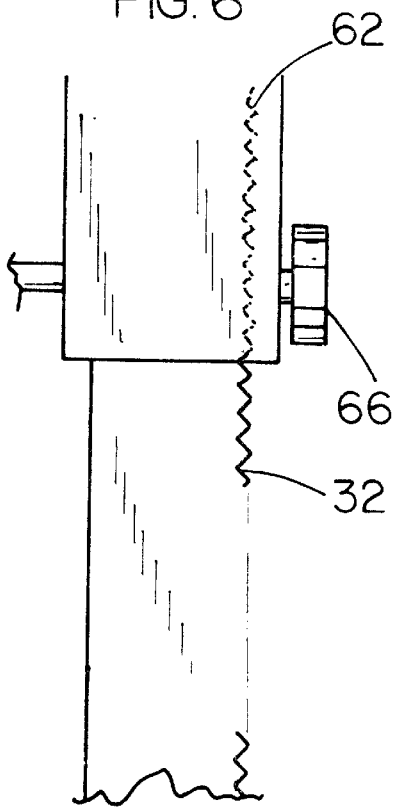
FIG. 6 is a schematic detail view of the sleeve member and leg of the present invention.

With reference now to the drawings, and in particular to FIGS. 1 through 6 thereof, a new ladder leveling system embodying the principles and concepts of the present invention and generally designated by the reference numeral 10 will be described.

As best illustrated in FIGS. 1 through 6, the ladder leveling system 10 generally comprises a ladder 20, a pair of legs 30, a plurality of clamping members 40, a rung level 52, a rail level 54, and a pair of foot members 50.

The ladder 20 has a pair of side rails 22 and a plurality of rungs 24 which extend between the side rails 22. Each of the rails 22 has a hollow interior.

Each leg 30 has a connection portion which is slidably inserted into the hollow interior of a side rail 22. The connection portion of each leg 30 has a plurality of leg teeth 32 on a first face of the leg 30.

Each of the hollow interiors of the side rails 22 has an associated interior face with a plurality of rail teeth 26. The rail teeth 26 are for receiving and mating with the leg teeth 32.

Each clamping member 40 is coupled to an associated on of the side rails 22. Each clamping member 40 is selectively extendable into the hollow interior of the associated side rail 22. The clamping members 40 urge the mating of the leg teeth 32 with the rail teeth 26. Thus, the associated leg 30 is held in a static position relative to the associated side rail 22.

The rung level 52 is coupled to the lowermost one of the plurality of rungs 24. The rung level 52 facilitates placing of the ladder 20 in such a manner that the rungs 24 are substantially horizontal while the ladder 20 is in use. A rail level 54 is coupled to a side rail 22.

Each foot member 50 is pivotally coupled to a bottom of an associated leg 30.

Each clamping member 40 has an associated threaded rod portion 42 and an associated head portion 44. Each of the side rails 22 includes an associated aperture 28 which extends through an associated one of the side rails 22. The threaded rod portion 42 of the clamping member 40 is threadedly inserted through the threaded aperture 28. Thus rotating the head portion 44 selectively, extends and retracts a distal end of the threaded rod portion 42 in the hollow interior of the side rail 22. Each clamping member 40 has a generally cross-shaped head portion 44 which facilitates gripping of the head portion 44 for rotating the head portion 44.

In an embodiment a sleeve member 60 allows the leg assembly 30 to be used with a conventional ladder. The sleeve member 60 has an interior face with a plurality of sleeve teeth 62 adapted for receiving and mating with the leg teeth 32. At least one extension portion clamping member 65 is used to urge the mating of the leg teeth 32 with the sleeve teeth 62. Each sleeve member 60 has a threaded aperture 64. Each extension portion clamping member 65 has a threaded rod portion and a head portion. The threaded rod portion of the extension portion clamping member 65 is threadedly insertable through an associated aperture 64 of the sleeve member 60. Thus rotating the head portion selectively extends and retracts the rod portion through the threaded aperture 64. Thus, the associated leg 30 is held in a static position relative to the associated sleeve 60. A first sleeve connection member and a second sleeve connection member are used to couple the sleeve member to the ladder. Each sleeve connection member has a hook portion 68 for engaging one of the side rails of the ladder. Each sleeve connection portion has a head portion 66, which is threadedly coupled to the hook portion 68 such that rotation of the head portion 66 selectively extends and retracts the hook portion 68 relative to the sleeve member 60. Thus the sleeve member 60 is securable to a side rail of a ladder. The hook portion 68 of the first sleeve connection member is positioned such that the distal end of the hook portion 68 faces rearward with respect to the sleeve member 60. The hook portion 68 of the second sleeve connection member is positioned such that the distal end of the of the hook portion 68 faced forward with respect to the sleeve member 60.

In use, the ladder is placed on a supporting surface such as the ground. The user then uses the rung level to determine if the ladder is level. If the ladder is not level, the user retracts the clamping members from the side rail and disengages the leg teeth from the rail teeth. The leg is then positioned relative to the rail, until the rung level indicated that the ladder is level. The user then extends the clamping members by rotating the head portions, and thereby engages the leg teeth with the rail teeth.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder leveling system comprising:

a ladder having a pair of side rails and a plurality of rungs extending between said side rails;

each of said rails having an associated hollow interior defined by a plurality of walls, each of said rails having an inner wall positioned toward said rungs such that said rungs are mounted on said inner walls of said rails, each of said rails having an outer wall located opposite said inner wall;

a pair of solid legs, each solid leg having an associated connection portion slidably inserted into a respective bottom of an associated one of said hollow interiors such that each said solid leg is positioned to extend downwardly out of said associated one of said side rails;

each said connection portion having an associated plurality of leg teeth on a first face of said associated connection portion, said first face of each said connection portion being located adjacent to said inner wall of said associated one of said side rails;

each said hollow interior of each said side rail having an associated interior face on said inner wall, each interior face on said inner wall having an associated plurality of rail teeth, each said plurality of rail teeth being for matingly receiving an associated one of said pluralities of leg teeth;

a plurality of clamping members, each clamping member being coupled to said outer wall of an associated one of said side rails, each said clamping member being selectively extendable into said hollow interior of said associated one of said side rails for urging said associated leg teeth into engagement with said associated rail teeth whereby said associated solid leg is held in a static position relative to said associated one of said side rails;

a rung level coupled to a lowermost one of said plurality of rungs for facilitatingly positioning of said ladder such that said rungs are in a substantially horizontal orientation during use of said ladder;

a rail level coupled to one of said side rails;

a pair of foot members, each foot member being pivotally coupled to a bottom of an associated one of said legs;

each said clamping member having an associated threaded rod portion extending from an associated head portion;

each of said side rails including an associated threaded aperture extending through an associated outer wall of said associated one of said side rails;

each said threaded rod portion of said associated clamping member being threadedly insertable through said associated threaded aperture whereby rotating said associated head portion selectively extends and retracts a distal end of said associated threaded rod portion in said associated hollow interior of said associated one of said side rails; and each said clamping member having a generally cross shaped associated head portion for facilitating gripping of said associated head portion for rotating said associated head portion.

* * * * *